United States Patent [19]

Hoffman et al.

[11] 4,363,208

[45] Dec. 14, 1982

[54] CERAMIC COMBUSTOR MOUNTING

[75] Inventors: Melvin G. Hoffman, Speedway; Frank W. Janneck, Danville, both of Ind.

[73] Assignee: General Motors Corporation, Detroit, Mich.

[21] Appl. No.: 205,417

[22] Filed: Nov. 10, 1980

[51] Int. Cl.[3] ..... F23R 3/60

[52] U.S. Cl. ..... 60/39.32; 60/753; 431/352

[58] Field of Search ..... 60/39.32, 753; 431/351-353, 158

[56] References Cited

U.S. PATENT DOCUMENTS

| | | | |
|---|---|---|---|
| 3,880,575 | 4/1975 | Cross et al. | 60/753 |
| 3,911,672 | 10/1975 | Irwin | 60/753 |
| 3,922,851 | 12/1975 | Irwin | 60/753 |
| 3,924,403 | 12/1975 | Irwin | 60/753 |
| 3,990,231 | 11/1976 | Irwin | 60/753 |
| 3,999,376 | 12/1976 | Jeryan et al. | 60/753 |

*Primary Examiner*—Robert E. Garrett

*Attorney, Agent, or Firm*—J. C. Evans

[57] ABSTRACT

A combustor for a gas turbine engine includes a metal engine block including a wall portion defining a housing for a combustor having ceramic liner components. A ceramic outlet duct is supported by a compliant seal on the metal block and a reaction chamber liner is stacked thereon and partly closed at one end by a ceramic bypass swirl plate which is spring loaded by a plurality of circumferentially spaced, spring loaded guide rods and wherein each of the guide rods has one end thereof directed exteriorly of a metal cover plate on the engine block to react against externally located biasing springs cooled by ambient air and wherein the rod spring support arrangement maintains the stacked ceramic components together so that a normal force is maintained on the seal between the outlet duct and the engine block under all operating conditions. The support arrangement also is operative to accommodate a substantial difference in thermal expansion between the ceramic liner components of the combustor and the metal material of the engine block.

4 Claims, 4 Drawing Figures

CERAMIC COMBUSTOR MOUNTING

This invention relates to gas turbine engine combustors and more particularly to support and seal assemblies for accommodating thermal expansion between ceramic combustor liners and a metal engine block.

The invention described herein was made in the performance of work under a NASA contact funded by the Department of Energy of the United States Government.

In order to improve the fuel efficiency of gas turbine engines it is desirable to fabricate the combustor liner of such engines from high temperature resistance ceramic materials. Such materials, however, are characterized by a reduced modulus of elasticity and, as such, must be isolated from loadings produced by differences in thermal expansion between metal supports and the ceramic material of the combustor liner components.

An object of the present invention is to provide an improved gas turbine engine combustor assembly including a metallic engine block housing for containing ceramic liner components of the combustor and including a ceramic outlet duct portion of the combustor liner supportingly received on a segment of an engine block defining a housing for the ceramic liner components of the combustor and including a compliant seal between the ceramic outlet duct and a support on the engine block to prevent bypass of high pressure air from a plenum supplying air to the combustor and wherein the combustor includes means for accommodating differential thermal growth between the metal engine block and the ceramic liner components to maintain a pressure seal between the combustor outlet duct and its support and to position the ceramic liner components together through a wide range of engine operating conditions and to do so by a plurality of spring loaded guide rods located circumferentially around the ceramic components.

Another object of the present invention is to provide an improved combustion apparatus for gas turbine engines including a multi-piece ceramic liner having an outlet duct portion at one end of the liner with a support flange and wherein the ceramic components are surrounded by a portion of a metal engine block to define a plenum space for combustion air supplied to the combustor; the block including a support flanges thereon against which the ceramic duct support flange is supported and sealed by a compliant seal and wherein the compliant seal is maintained in sealing relationship between the respective flanges by a biasing system including a load plate held against a ceramic liner component on the opposite end of the liner; the biasing system including a plurality of spaced guide rods connected thereto and spring biased thereagainst by spring means located externally of the engine block at a point cooled by ambient air and operative to accommodate thermal expansion between the ceramic liner components and the engine block throughout a wide range of engine operating conditions.

Still another object of the present invention is to provide an improved gas turbine engine combustor assembly having a metal engine block with a housing that forms an inlet air plenum for supplying high pressure air to the combustor from a turbine operated gasifier compressor and wherein the combustor includes a ceramic liner having a ceramic outlet tube with a thermal coefficient of expansion less than that of the engine housing; the outlet tube extending through an annular support flange on the engine housing and the outlet tube having a flange integrally formed thereon to form one seat for a compliant seal member on the support flange that prevents bypass of combustor air from the inlet air plenum and the outlet tube being located in axial alignment with a reaction chamber forming a ceramic liner closed at one end thereof by a ceramic bypass plate each having a coefficient of expansion corresponding to that of the outlet; the assembly further including a plurality of equidistantly spaced spring supports each having a guide rod in engagement with means for supporting the ceramic bypass plate and each extending exteriorly of the engine block into engagement with a biasing spring supported externally of the engine block to be cooled by ambient air and with the rods being adjustably positioned by the spring to accommodate for differential thermal expansion between the ceramic components and the engine block to prevent excessive build-up of stress in the ceramic components while maintaining a continuous spring loading on the seal member to prevent bypass from the inlet plenum.

Still another object of the present invention is to provide a combustion apparatus of the type set forth in the preceding object wherein the engine housing has a circumferentially located guide plate thereon with tabs formed to react laterally with a metal carrier plate for the ceramic components to maintain the ceramic components in axial alignment during gas turbine engine operation.

Yet another object of the present invention is to provide a combustion apparatus in either one of the two preceding objects wherein the combustion apparatus includes a fuel injection nozzle fixedly supported to the engine block for supplying fuel to the combustion apparatus and wherein air flow control means are supported on the outboard surface of the ceramic bypass plate and operative to vary the amount of air flow into a reaction chamber of the combustor and wherein coupling means are provided to slidably connect the fuel injection nozzle with respect to the engine air flow control means to accommodate relative thermal expansion between the engine block and the ceramic combustor components of the assembly.

Further objects and advantages of the present invention will be apparent from the following description, reference being had to the accompanying drawings wherein a preferred embodiment of the present invention is clearly shown.

Figure 1:
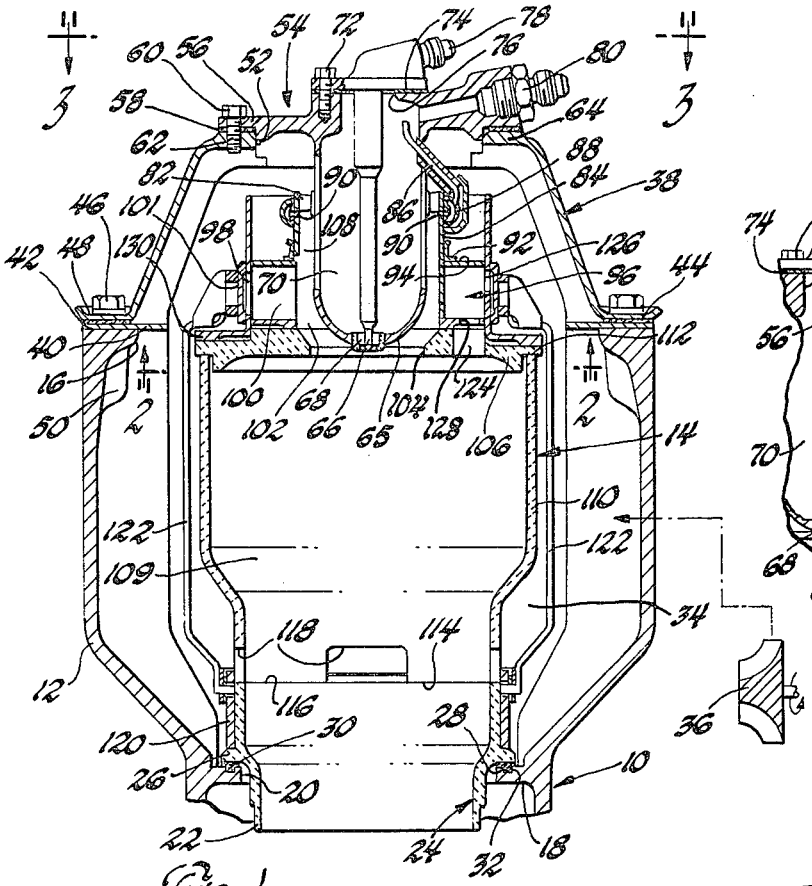
FIG. 1 is a vertical sectional view of combustion apparatus including the present invention.
Figure 4:
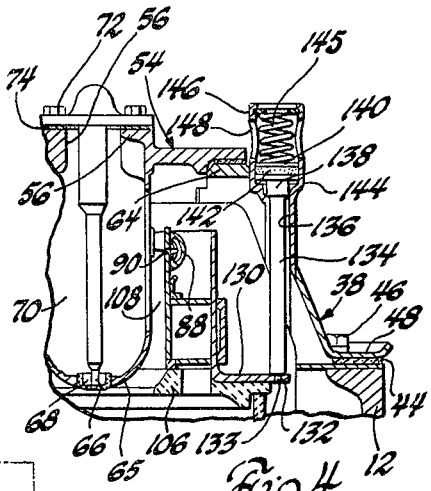
FIG. 4 is a fragmentary sectional view taken along the line 4—4 of FIG. 3.

Referring now more particularly to the drawings, an engine block 10 of ductile metal material such as cast nodular iron includes a generally upstanding wall 12 thereon which surrounds a combustion apparatus 14 having a longitudinal axis which, though shown vertical in FIG. 1, will in some working embodiments be located at an inclination from vertical in order to accommodate the wall portion 12 of the engine block 10 and combustion apparatus 14 therein within the confines of a desired engine compartment space.

The wall portion 12 defines a combustor entrance opening 16 exteriorly of the engine block through which the combustion apparatus 14 can be inserted within the engine block 10. The engine block 10 more particularly includes an internal support flange 18 therein defining a bore 20. The outlet end 22 of a ceramic combustor outlet transition tube 24 is located in bore 20. The tube 24 has an integrally formed flange 26 thereon that forms an annular surface 28 defining one seal surface for an annular compliant seal 30 that is retained within an annular groove 32 on the flange 18. The arrangement defines a high pressure seal against bypass of the pressurized air from an air supply plenum 34 formed within the wall 12 and in communication with the outlet of a gasifier compressor 36 that is driven by the gas turbine to supply combustion air for the combustion apparatus 14. The plenum 34 is closed at its upper end by a cover 38 which is sealed with respect to a guide plate 40. Plate 40 is supported on the upper end 42 of the wall 12 and carries an annular seal 44. Seal 44 is compressed by a plurality of connector screws 46 directed through the flange 48 of the cover into threaded engagement with the wall 12 at internally threaded bosses 50 thereon. The cover includes a bore 52 through which the center body 54 is inserted. The centerbody assembly 54 includes a flange 56 secured in place on the cover 38 and sealed with respect thereto by a gasket 58 which is seated by a plurality of screws 60 located at spaced points along the flange 56 and directed into threaded engagement with threaded holes 62 in the upper end 64 of the cover 38. The flange 56 has a centerbody assembly 54 dependent therefrom and includes a pilot nozzle 66 centered therein and surrounded by a ring of air swirler vanes 68 to swirl air from the interior space 70 of the centerbody assembly 54 for mixture with fuel from the pilot nozzle 66. The pilot nozzle 66 is secured by screws 72 against a seal gasket 74 that surrounds a center opening 76 within the flange 56 as best shown in FIG. 1. The pilot nozzle 66 is connected to an inlet fitting 78 for supplying fuel thereto from a fuel control system of a gas turbine engine. Additionally, the centerbody assembly 54 includes an air supply fitting 80 for directing air into the space 70 and to a cascade of axially formed swirler vanes 82 at the inlet to a tubular prechamber wall 84 located in surrounding relationship to the outer surface of the centerbody assembly 54. The prechamber wall 84 is heated during engine start to serve as a vaporizing surface for fuel flow from a tube 86 into a ring plenum 88 that communicates through a plurality of orifices 90 to direct the fuel as a film which flows across the inner surface of the wall 84 for vaporization during gas turbine engine operation. The inboard edge of the wall 84 is slidably received within a guide ring 92 fixed to an outboard wall 94 of an inlet air swirler 96 which has a plurality of circumferentially spaced inlet flow ports 98 directed therethrough to supply air into a plurality of radially inwardly directed swirl passages 100 which are tangentially formed with respect to the circle defined by tubular wall 84. Flow through passages 100 is under the control of an axially reciprocal control ring 101 to regulate the amount of inlet air flow into an annular air/fuel supply passage 102 formed between the center body assembly 54 and an inlet bore 104 formed in a bypass swirler plate 106 of ceramic material. The passage 102 restricts entrance of the combustion flame front into a prevaporization chamber 108 formed upstream thereof.

In accordance with the present invention, the bypass swirler plate is constructed of ceramic material for resisting the high temperature flame front within a reaction chamber 109 formed by the bypass plate 106 and a ceramic reaction chamber liner wall 110 that has the upper edge 112 thereof supporting the swirler plate 106. Wall 110 includes an outlet edge 114 thereon in engagement with the inlet edge 116 of the outlet transition tube 24. The reaction chamber liner wall 110 is fabricated from high temperature resistant ceramic material and includes a plurality of notched secondary air flow holes 118 therein having air flow controlled therethrough by means of a ported control ring 120 slidably supported on the outer surface of the tube 24 inboard of the flange 26 thereon and connected by a plurality of circumferentially spaced control straps 122 to the radial swirler control ring 101.

Figure 3:
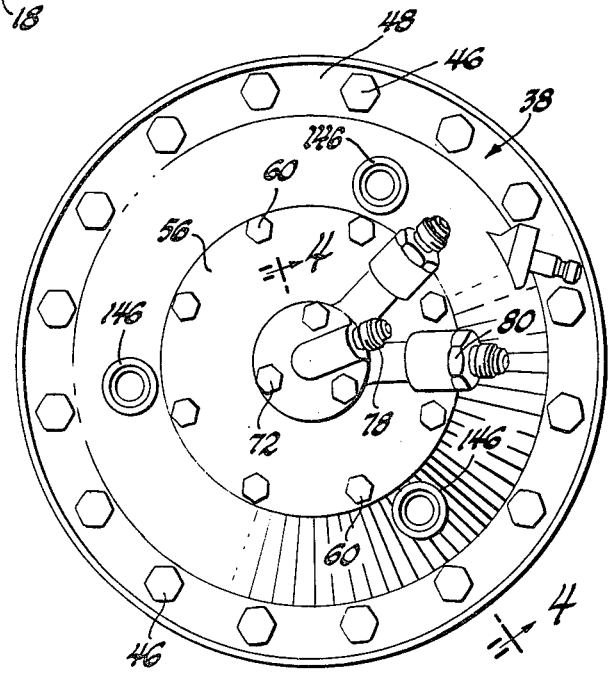
FIG. 3 is a top elevational view looking in the direction of the arrows 3—3 in FIG. 1.

The swirler plate 106 includes a plurality of inclined passages 124 therethrough. Passages 124 receive bypass flow as established by flow balance through passages 126, 128 in the radial swirler 96. When the control ring is in a maximum air flow position, more combustion air is directed into the reaction chamber 109 through passages 124 so as to reduce the reaction temperature therein to control production of oxides of nitrogen under full load conditions of operation of the gas turbine engine. During this phase of operation, the control ring 120 will partially or fully block the holes 118 to maintain proportionate flow of desired amounts of air into different portions of the reaction chamber 109. The ceramic swirler plate 106 is backed by a metal support or carriage plate 130 which has a plurality of radially outwardly directed tabs 132 thereon each of which connects to the end 133 of a support guide rod 134. Each rod 134 extends through a bore 136 in the cover 38 to an end 138 of the rod 134 located outboard of cover 38. The outboard end 138 is connected to a piston 140 having an annular seal 142 thereon sealingly engaged with the inner surface of a seal cylinder 144 to pressure seal the rod 134 as it exits the cover 38. The sealed piston 140 is engaged by a biasing spring 145 captured in a cage 146. Cage 146 has air flow openings 148 therethrough so that the spring 145 will be cooled by ambient air surrounding the engine block. The springs 145 (three in number as shown in FIG. 3) bias the plate 130 and the bypass swirler plate 106 so as to maintain the ceramic liner components including the liner wall 110 and the outlet transition tube 24 toward the engine block 10 so as to maintain the compliant seal 30 compressed during a wide range of engine operating conditions to prevent air bypass from the plenum 34 at the joint between transition tube 24 and the block 10. The arrangement defines a normal force acting on the compliant seal 30 under all operating conditions. Furthermore, the arrangement is such that substantial differences in thermal coefficient of expansion between the ceramic liner components and the cast iron material of the block 10, for example, in the order of a three to one ratio, will be accommodated by a movement of the rods 134 outwardly of the cover 38 against springs 145.

Figure 2:
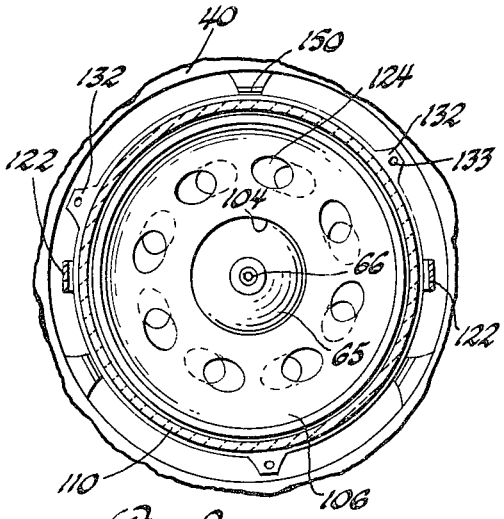
FIG. 2 is a cross sectional view taken along the line 2—2 of FIG. 1 looking in the direction of the arrows.

Lateral loads on the liner components are reacted by a plurality of radial stops 150 formed at circumferentially located points around the guide plate 40 as best shown in FIG. 2. Each stop 150 is the form of a bent tab in close proximity to the outer edge of plate 130.

While the embodiment of the present invention, as herein disclosed, constitutes a preferred form, it is to be understood that other forms might be adopted.

The embodiments of the invention in which an exclusive property or privilege is claimed are defined as follows:

1. In a gas turbine engine having a spool with an air compressor and a turbine for driving said compressor and a metal engine block for enclosing the spool the improvement comprising: a combustor wall portion of the metal engine block forming an inlet air plenum for supplying air to a combustor and adapted to be fluidly connected to the air compressor, said combustor wall portion including an annular resilient seal thereon, a ceramic combustor outlet transition tube having a thermal expansion coefficient less than that of the metal engine block and extending through said annular resilient seal and having a bearing flange thereon supportingly received by the resilient seal, a ceramic combustor liner supported on said transition tube in axial alignment therewith and including an upper open end, a ceramic bypass plate having a coefficient of expansion corresponding to that of said transition tube and said combustor liner and vertically supported on said upper open end to define a high temperature reaction chamber within said ceramic combustor liner, and means including a plurality of equidistantly spaced spring supports located externally of the metal engine block to be cooled by ambient air and operative to position and seal the ceramic combustor liner to the outlet transition tube and the ceramic bypass plate to the upper open end and to position them together against mechanical and thermal expansion induced loading therebetween during combustor operation.

2. In a gas turbine engine having a spool with an air compressor and a turbine for driving said compressor and a metal engine block for enclosing the spool the improvement comprising: a combustor wall portion of the metal engine block forming an inlet air plenum for supplying air to a combustor and adapted to be fluidly connected to the air compressor, said combustor wall portion including an annular resilient seal thereon, a ceramic combustor outlet transition tube having a thermal expansion coefficient less than that of the metal engine block and extending through said annular resilient seal and having a bearing flange thereon supportingly received by the resilient seal, a ceramic combustor liner supported on said transition tube in axial alignment therewith and including an upper open end, a ceramic bypass plate having a coefficient of expansion corresponding to that of said transition tube and said combustor liner and vertically supported on said upper open end to define a high temperature reaction chamber within said ceramic combustor liner, and means including a plurality of equidistantly spaced spring supports located externally of the metal engine block to be cooled by ambient air and operative to position and seal the ceramic combustor liner to the outlet transition tube and the ceramic bypass plate to the upper open end and to position them together against mechanical and thermal expansion induced loading therebetween during combustor operation, and means to react lateral loading between the combustor wall portion of the metal engine housing and the combustor liner to guide the positioned and sealed ceramic components for relative expansion with respect to the metal engine housing so as to maintain the components axially aligned with said means for positioning and biasing the ceramic components together under cold engine operating conditions to higher temperature conditions.

3. In a gas turbine engine having a spool with an air compressor and a turbine for driving said compressor and a metal engine block for enclosing the spool the improvement comprising: a combustor wall portion of the metal engine block forming an inlet air plenum for supplying air to a combustor and adapted to be fluidly connected to the air compressor, said combustor wall portion including an annular resilient seal thereon, a ceramic combustor outlet transition tube having a thermal expansion coefficient less than that of the metal engine block and extending through said annular resilient seal and having a bearing flange thereon supportingly received by the resilient seal, a ceramic combustor liner supported on said transition tube in axial alignment therewith and including an upper open end, a ceramic bypass plate having a coefficient of expansion corresponding to that of said transition tube and said combustor liner and vertically supported on said upper open end to define a high temperature reaction chamber within said ceramic combustor liner, fuel injection means fixed to the metal block for supplying an air/fuel mixture into said reaction chamber for combustion therein to produce motive fluid for flow through the outlet transition tube to drive the turbine, air flow control means supported on the outboard surface of the axially aligned bypass plate for varying the amount of primary air flow into said reaction chamber, and coupling means for slidably connecting said fuel injection means and said air flow control means to accommodate relative thermal expansion between the metal engine block and the aforementioned ceramic combustor components, and means including a plurality of equidistantly spaced spring supports located externally of the metal engine block to be cooled by ambient air and operative to position and seal the ceramic combustor liner to the outlet transition tube and the ceramic bypass plate to the upper open end and to position them together against mechanical and thermal expansion induced loading therebetween during combustor operation.

4. In a gas turbine engine having a spool with an air compressor and a turbine for driving said compressor and a metal engine block for enclosing the spool the improvement comprising: a combustor wall portion of the metal engine block forming an inlet air plenum for supplying air to a combustor and adapted to be fluidly connected to the air compressor, said combustor wall portion including an annular resilient seal thereon, a ceramic combustor outlet transition tube having a thermal expansion coefficient less than that of the metal engine block and extending through said annular resilient seal and having a bearing flange thereon supportingly received by the resilient seal, a ceramic combustor liner supported on said transition tube in axial alignment therewith and including an upper open end, a ceramic bypass plate having a coefficient of expansion corresponding to that of said transition tube and said combustor liner and vertically supported on said upper open end to define a high temperature reaction chamber within said ceramic combustor liner, fuel injection means fixed to the metal block for supplying an air/fuel mixture into said reaction chamber for combustion therein to produce motive fluid for flow through the outlet transition tube to drive the turbine air flow control means supported on the outboard surface of the axially aligned bypass plate for varying the amount of primary air flow into said reaction chamber, and coupling means for slidably connecting said fuel injection means and said air flow control means to accommodate relative thermal expansion between the metal engine block and the aforementioned ceramic combustor components, and means including a plurality of equidistantly spaced spring supports located externally of the metal engine block to be cooled by ambient air and operative to position and seal the ceramic combustor liner to the outlet transition tube and the ceramic bypass plate to the upper open end and to position them together against mechanical and thermal expansion induced loading therebetween during combustor operation, and means to react lateral loading between the combustor wall portion of the metal engine housing and the combustor liner to guide the positioned and sealed ceramic components for relative expansion with respect to the metal engine housing so as to maintain the components axially aligned with said means for positioning and biasing the ceramic components together under cold engine operating conditions to higher temperature conditions.

* * * * *